United States Patent [19]

Molitor et al.

[11] Patent Number: 4,650,193

[45] Date of Patent: Mar. 17, 1987

[54] GOLF BALL

[75] Inventors: Robert P. Molitor, Niles, Mich.; Terrence Melvin, Sommers, Conn.

[73] Assignee: Spalding & Evenflo Companies, Inc., Tampa, Fla.

[21] Appl. No.: 680,085

[22] Filed: Dec. 10, 1984

[51] Int. Cl.[4] ..... A63B 37/06

[52] U.S. Cl. ..... 273/228; 273/230; 264/265

[58] Field of Search ..... 273/235 R, 218, 213, 273/214, 215, 216, 217, 220, 230

[56] References Cited

U.S. PATENT DOCUMENTS

| | | | |
|---|---|---|---|
| 3,692,719 | 9/1972 | Srail et al. | 260/23.5 A |
| 3,784,209 | 1/1974 | Berman | 273/218 |
| 3,909,466 | 9/1975 | Matsui et al. | 260/3 |
| 3,932,353 | 1/1976 | Mastrolia et al. | 260/45 |
| 4,070,344 | 1/1978 | Hergenrother et al. | 260/77.5 |
| 4,141,559 | 2/1979 | Melvia et al. | 273/220 |
| 4,165,877 | 8/1979 | Miller et al. | 273/218 |
| 4,169,599 | 10/1979 | Fujio et al. | 273/220 |
| 4,239,860 | 12/1980 | Hergenrother et al. | 525/131 |
| 4,264,075 | 4/1981 | Miller et al. | 273/235 |
| 4,431,193 | 2/1984 | Nesbitt | 273/235 R |

FOREIGN PATENT DOCUMENTS

| | | | |
|---|---|---|---|
| 1087780 | 10/1967 | United Kingdom | 273/218 |

*Primary Examiner*—George J. Marlo
*Attorney, Agent, or Firm*—Donald R. Bahr

[57] ABSTRACT

Disclosed is a two-piece golf ball and methods for its production. The ball comprises a core having a central portion of a cross-linked, hard, resilient material and having a soft, deformable outer layer. Balls comprising the novel cores and a conventional cover material having playability properties approaching or exceeding thread-wound balata covered balls. The core is preferably manufactured by surface treating a slug of a suitable, curable elastomer composition with a cure altering agent, and molding the slug under conditions to produce a spherical core having a hardness gradient in its surface layers.

12 Claims, 2 Drawing Figures

GOLF BALL

BACKGROUND OF THE INVENTION

Figure 1:
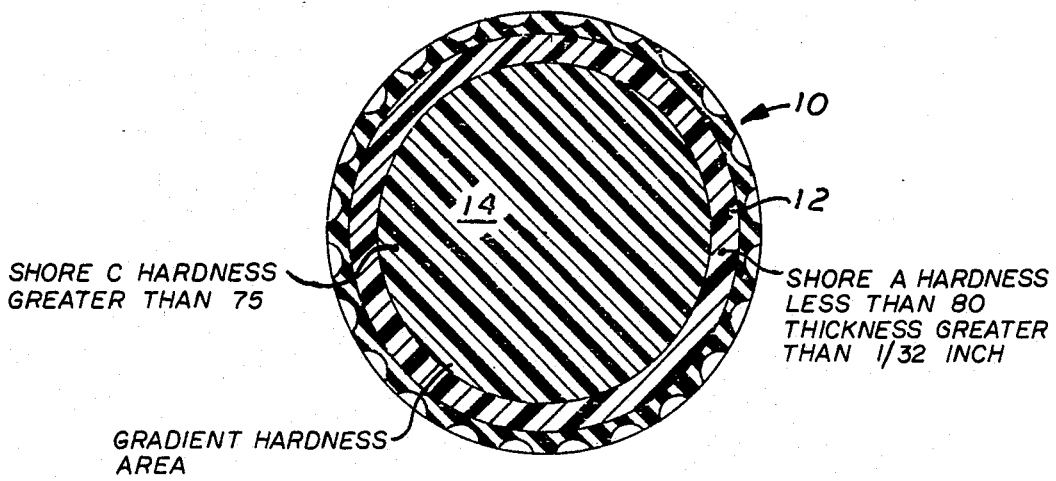

This invention relates to golf balls and more particularly to an improved golf ball core useful in making two-piece balls having superior short iron and other playability characteristics.

For many years top grade golf balls have been made by molding balata, trans polyisoprene, trans polybutadiene, or various compositions including such elastomers about elastic, thread-wound cores. An experienced player can apply spin to a balata-covered wound ball such that it will fade or draw in flight or have the backspin necessary to stop abruptly on the green when hit with a short iron. These playability properties are most important in short iron play and can be exploited significantly only by relatively skilled players.

Balata and its synthetic substitutes today have essentially been replaced by new materials. With the exception of a few lines of golf balls distributed through pro shops to professional golfers and those who would emulate them, newer synthetic polymers are the cover materials of choice.

Of the new synthetics, by far the most commonly used are a line of ionomers sold by E. I. Dupont de Nemours & Company under the trademark SURLYN. These materials comprise copolymers of olefins, typically ethylene, with an alpha, beta, ethylinically unsaturated carboxylic acid such as methacrylic acid. Metal ions such as sodium or zinc are used to neutralize some portion of the acid groups in the copolymer resulting in a thermoplastic resin which has several advantages including a cost advantage over balata. The ionomers may be manufactured with a wide variety of properties which, in a golf ball cover, affect cut resistance, shear resistance, general durability, and resilience.

U.S. Pat. No. 3,819,768 to R. P. Molitor discloses that blends of sodium neutralized ionomer resins with zinc neutralized ionomer resins, as a class, have certain advantages which have not been achievable in any other way. Among these is the production of an unexpectedly high coefficient of restitution of golf balls having the blended ionomer cover. Such covers also resist cold cracking, have excellent aging properties, and are unexpectedly durable. The development of the SURLYN blended cover has been a major factor in the production of two-piece balls having covers which for all practical purposes cannot be cut in play, and which travel further when hit than any other USGA regulation ball as measured by controlled tests when hit by golfers or testing machines.

Such balls typically have a separately molded, solid resilient core. The core is manufactured by compression molding a slug of cross-linkable elastomer composition, e.g., those disclosed in U.S. Pat. Nos. 4,464,075, 4,169,599, 4,165,877, or 4,141,599. It is believed that most high quality two-piece balls sold in the United States currently have cores consisting of a high cis content polybutadiene, a zinc salt of an alpha, beta, ethylinically unsaturated monocarboxylic acid, e.g., zinc di or mono acrylate or methacrylate, and a small amount of zinc oxide, cured with conventional free radical initiator type catalysts, typically a peroxide.

While the balata covered, thread-wound balls are easily cut and very expensive, they nevertheless have a significant edge in short iron playability. It is much more difficult to impart spin to two-piece balls and thus more difficult to fade or draw drives or to chip with precision. Frequently, experienced players note that the ionomer covered two-piece balls, although long off the woods and irons, have an unsatisfactory "feel".

The manufacture of two-piece balls, i.e., balls comprising a solid, molded, resilient core and a cover, has many significant advantages over the more expensive wound balls. There is accordingly a need for two-piece balls having short iron playability characteristics comparable to wound, balata rubber-covered balls. A ball having such properties which also had the "distance" of ionomer blend covered two-piece balls would be attractive to golfers.

SUMMARY OF THE INVENTION

It has now been discovered that a key to manufacturing a two-piece ball having short iron and other playability characteristics similar to balata-covered wound balls is to construct a ball having a soft, resilient, layer beneath the cover. The soft underlayer allows the cover to deform more during the hit and increases the area of contact between the club face and the ball cover with the result that more spin can be imparted to the ball.

The underlayer is preferably formed, in accordance with the invention, by modifying the cure of surface layers of the core during compression molding. This is accomplished by exposing the surface of a slug of the cross-linkable elastomer composition prior to molding to an agent which modifies the cure. The core's central portion becomes resilient and hard when cured, has a Shore C hardness greater than 75, and cures in the conventional way. The surface layers are cross-linked differently, resulting in a much softer, resilient layer, generally having a Shore A hardness less than 80 and a thinkness greater than one-thirty second of an inch. The currently preferred ball embodying the invention has an outer layer greater than one-sixteenth of an inch, e.g., about 0.072 inch, having a Shore A hardness less than 75, e.g., 74. Its central portion has a Shore C hardness of 82 or higher. The preferred agent for modifying cross-linking is a sulfur-bearing material such as a thiol or mercaptan, and most preferably is elemental sulfur.

Broadly, however, other methods may be used to attain a similar result. For example, a thin layer of a separate elastomer composition which produces a soft layer when cured may be wrapped about a harder central elastomer composition and the layers may be cured either separately or together. Conventional core formulations suitably modified as described above may be used in the practice of the invention. The core composition disclosed in copending applicaton Ser. No. (680,085) may also be used. That composition includes a polyfunctional isocyanate in addition to the usual peroxide catalyst for curing the polybutadiene and metal acrylate or methacrylate, and produces cores of exceptionally high coefficient of restitution.

Covers of conventional formulation may be used with the new core. Thus ionomer, urethane, balata, or other elastomer-based cover materials are suitable. A blended ionomer cover may be applied to cores manufactured as disclosed herein to produce two-piece balls having a unique combination of desirable properties. Such balls can be substantially cut-proof, long off the irons and woods, and characterized by short iron and wood playability characteristics and spin rates that approach or exceed balata-covered wound balls. Furthermore, the balls can have a "click" and "feel" comparable to balata-covered wound balls.

The golf ball of the invention accordingly comprises a molded cover and a separately molded resilient core comprising a central portion having a Shore C hardness greater than 75 and an outer layer, integral with and disposed radially outwardly from the central portion, having a Shore A hardness less than 80 and a thickness greater than 1/32 inch. The outer layer will normally be cross-linked differently from the central portion, and preferably, the same elastomers are used for both regions of the core. A preferred structure comprises a single elastomer composition having a hardness gradient disposed between the central portion and the outer layer.

The currently preferred core of the invention comprises high cis content polybutadiene blended with a zinc mono or di acrylate or methacrylate and zinc oxide. The core is cross-linked, in its central portion, with one or more conventional peroxide, free radical initiator catalysts, and optionally also with a diisocyanate. In its outer layer, the peroxide cross-linking is modified by the presence of a sulfur-bearing material, resulting in a relatively soft, elastomeric, and easily deformed core surface layer.

Golf balls embodying the invention deform more than conventional two-piece balls when hit. This means that they have improved "click" and "feel", and that the area of contact of the club face with the ball is greater during the hit. Golfers are accordingly better able to control the hit and to apply spin to fade, draw, or stop a shot. Furthermore, the existence of the soft layer interposed between the inner core and the cover permits the inner core to be made harder and more resilient than the cores of conventional two-piece balls. Ball manufacturers can therefore closely approach the maximum distance and initial velocity specifications of the USGA with a two-piece ball which is less expensive to make than a wound ball but has similar playability characteristics.

Accordingly, it is an object of the invention to provide a golf ball having a soft layer beneath the cover and integral with the core which imparts improved properties to two-piece balls. Another object is to provide a two-piece ball having short iron and wood playability characteristics equal to or exceeding thread-wound balata-covered balls. Still another object is to provide a method of producing golf balls having a core which is soft on its surface but hard and resilient in its central portions. Yet another object is to construct a golf ball having the distance, durability, and ease of manufacture of two-piece balls and the playability characteristics of wound balls.

These and other objects and features of the invention will be apparent from the following description and from the drawings.

Figure 2:
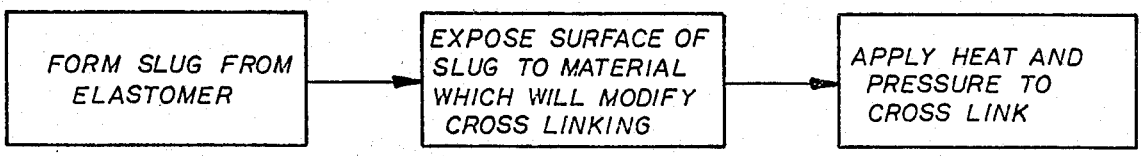

FIG. 1 is a schematic cross section of a ball of the invention illustrating the hardness of various regions of the core, and FIG. 2 illustrates a process of making a ball core of the invention.

DESCRIPTION

Broadly, the golf ball core of the invention consists of a spherical central portion which is hard and resilient, which may be formed by molding conventional core formulations, and a soft, relatively easily deformed outer layer, integal with the central portion.

Conventional solid cores are typically compression or injection molded from a slug of uncured elastomer composition comprising polybutadiene and a metal salt of an alpha, beta, ethylinically unsaturated monocarboxylic acid. Metal oxide or other fillers such as barytes may also be included to increase core weight so that the finished ball more closely approaches the USGA upper weight limit of 1.620 ounce.

More specifically, a polybutadiene elastomer, preferably comprising as much cis polybutadiene as possible, is blended together with (1) a metal salt such as zinc mono or di acrylate or methacrylate, or various mixtures thereof, (2) optionally a relatively inert higher specific gravity filler such as zinc oxide to increase the weight of the core, (3) optionally a low molecular weight fatty acid having, for example, 10–40 carbon atoms, e.g., stearic acid, and (4) a free radical initiator catalyst such as a peroxide. As disclosed in detail in copending application Ser. No. (680,085), the disclosure of which is incorporated herein by reference, a small amount of a polyfunctional, preferably difunctional isocyanate having 3–30 carbon atoms may also be included in the blend to act as an auxiliary curing aid with a resulting increase in the coefficient of restitution of the core.

Generally, for each 100 parts polybutadiene, the core composition includes 20–50 parts carboxylic acid salt, 0–20 parts low molecular weight fatty acid, 1–10 parts peroxide, and 0.01–10 parts, preferably 1–2 parts, of a polyfunctional isocyanate. The ratios of ingredients may vary and are best optimized empirically. The amount of polyvalent isocyanate used, if any, will vary depending on the particular monocarboxylic acid, peroxide, and polybutadiene employed, and the relative amounts used.

The foregoing core formulation comprise preferred materials for the central portion of the core of the invention, but many other known compositions may be used. In particular, the foregoing formulations may be modified by the addition of other ingredients. For example, high specific gravity fillers such as barium sulfate may replace or be added to the zinc oxide to increase the weight of the ball as desirable or as necessary to have the ball reach or closely approach the USGA weight limit of 1.620 ounce. In addition, small amounts of ionomers of the type described previously, natural or synthetic rubbers, e.g., styrene butadiene, and other compatible elastomers may be used as diluents. It is also possible to add other cross-linking aids such as low molecular weight liquid polycarboxylic acid esters, e.g., trymethylolpropane trimethacrylate, ethylene glycol dimethacrylate, or 1,3-butylene glycol dimethacrylate. Also, coagents useful in peroxide curing may be used, e.g., N N′ m-phenylene dimaleimide.

The formulation of the outer layer of the core, and especially the ingredients which control curing if a cross-linkable formulation is selected, is designed to result in a soft, elastomeric layer integral with the central portion. When the central composition and outer layer comprise incompatible polymers, adhesives may be used. Broadly, any moldable resilient material or a mixture of materials may be used to form the outer layer, provided it is elastomeric and has a Shore A hardness when cured less than 80, preferably less than 75. Thus, thermoplastic elastomers which are widely commercially available may be used. Also, various synthetic or natural rubbers such as balata and various blended compositions containing these rubbers may be used.

The soft outer layer of the core may be formulated separately and wrapped or injection molded about a suitably sized slug of elastomer of the type described above. Thereafter the bilayered, uncured, composite slug may be molded in a single operation. Alternatively, the central portion of the core may be compression molded in undersized mold cavities, and the outer layer subsequently applied and cured if necessary.

It is currently preferred to form the outer layer from the same elastomeric materials as the central portions of the core, and to cross-link both in a single curing operation. In this case, the outer layer and central portion must necessarily comprise different cross-linking systems in order to achieve production of regions of markedly different hardness.

There are various ways this goal can be achieved. For example, one can formulate separate batches of a polybutadiene - metal acrylate based core composition of the type described above which have different free radical initiator catalysts, different amounts of catalyst, or catalyst which promote cure at significantly different rates. The composition which, when cured for a given time and temperature, results in the soft material desired for the outer layer, may then be wrapped about a slug of the other composition, and the composite slug cured during compression molding in a single operation.

However, the preferred method is to formulate a single batch of cross-linkable core material having a cross-linking agent or agents designed to produce the desired hardness and resilience of the central portion, and then to expose surface layers of the slug to a material that will inhibit curing or otherwise alter the cure and will penetrate surface layers of the composition during heating to produce a soft outer layer cured differently from the core's center.

Exposure of the slug may be effected by dipping in or spraying with a liquid cure altering agent or a solution of a liquid or solid cure altering agent, by adhering a solid, powdered cure altering agent to the slug, by coating the mold cavity with the agent, or by other means. The particular cure altering agent used and the amount used must necessarily be selected and optimized for a given core composition. Cross-linking agents and substances which inhibit cross-linking of the elastomers which have been used for golf ball cores are well understood by those skilled in the art.

For manufacturing the preferred core of the invention, a sulfur-bearing material such as a thiol or mercaptan or, most preferably, elemental powdered sulfur is used to alter the cure of a composition of the type described above comprising a high cis content polybutadiene, a metal, preferably zinc salt of mono or di acrylate or methacrylate, most preferably zinc diacrylate, a small amount of zinc oxide, and a free radical initiator catalyst, preferably a peroxide. The currently preferred free radical initiator catalyst is n butyl 4,4' bis (butyl peroxy) valerate. Other conventional rubber curing peroxides may be used. Non-limiting examples include dicumyl peroxide, 1,1-bis (t-butyl peroxy)-3,3,5-trimethylcyclohexane, di-t-butyl peroxide, and 2,5 di (t-butylperoxy)-2,5-dimethyl hexane. As noted above, a polyfunctional isocyanate, preferably an isocyanate having 3–30 carbon atoms and two reactive isocyanate groups, may be used to increase the coefficient of the central portion of the core. While 0.01 to 10 parts isocyanate may be used, best results are typically obtained with 1–3 parts.

In the manufacture of the cores, preferably all ingredients except the cross-linking agents are mixed and thoroughly blended using conventional mixing equipment. The peroxide and, optionally, the diisocyanate are then added while the temperature of the mixture is on the order of 200° F. The blend is extruded to form slugs of a weight slightly greater than the weight of the cores to be produced. The surface of each slug is then exposed to the sulfur-bearing material, and then the slug is molded at a temperature above about 295° F. The slug is placed in the cavity of a two-part mold which is closed to compress the elastomer composition and heated. For metal molds, a mold release agent may be used, e.g., vinyl chloride films or a layer of polyethylene. After curing the cores for 10 to 20 minutes (depending on the temperature of the cure), the mold is opened and the flashing is removed. A thin surface layer of the cores, including any adhering mold release material, is then ground off.

While the reaction which takes place is not well understood, it is believed that a complex network of cross-links between the unsaturated components of the blend are formed in the central portion of the core which is unaffected by the cure altering agent. A surface layer of the core interacts during cure with the sulfur-bearing material. Either cross-linking of unsaturated sites in the blend components is inhibited, or sulfur cross-links are formed instead of or in addition to the covalent, free radical initiated cross-links, or both. In any event, a differently cured, soft and relatively amorphous outer layer having a relatively low stretch modulus is produced, generally of a thickness of about 1/16 inch.

Optionally, prior to injection or compression molding a cover about the cores, the cores may be dipped in a solution of an adhesive, e.g., an epoxy-based adhesive.

The cover molded about the cores can comprise balata, various ionomers of the type known to those skilled in the art or blends thereof, and various resilient compositions such as are disclosed in U.S. Pat. No. 3,359,231, 4,398,000, 4,234,184, 4,295,652, 4,248,432, 3,989,516, 3,310,102, 4,337,947, 4,123,061, and 3,490,146. If it is desired to further increase the coefficient of restitution of the golf ball, a cover embodying the invention disclosed in U.S. Pat. No. 3,819,768 may be used. A cover for use on the golf ball which aids in improving its playability characteristics is disclosed in detail in copending U.S. application Ser. No. (680,087), the disclosure of which is incorporated herein by reference. Briefly, this new cover comprises a blend of a thermoplastic urethane having a Shore A hardness less than 95 and a ionomer material having a Shore D hardness greater than 55, such as those disclosed in U.S. Pat. No. 3,264,272 and sold by E. I. Dupont de Nemours Company under the trademark SURLYN, at a weight ratio sufficient to produce a cover having a shore C hardness within the range of 70 to 85.

The invention will be further understood from the following non-limiting example:

EXAMPLE

Golf ball cores embodying the invention may be manufactured by blending a conventional core formulation from the following ingredients in the following parts by weight:

| Ingredient | Parts by Weight |
|---|---|
| polybutadiene | 100 |
| zinc oxide | 5 |
| barium sulfate | 17.4 |
| stearic acid | 3 |
| zinc diacrylate | 27.13 |
| ground flash[1] | 17.4 |
| dicumyl peroxide | 3 |

[1]grindings from previously manufactured cores of substantially identical composition.

The ingredients are thoroughly blended and then extruded into slugs of a weight slightly greater than the desired final weight of the core to be produced. The slug of elastomer material is then tumbled briefly in elemental powdered sulfur to loosely adhere a uniform thin sulfur coating about its surface. The slug is then placed in a mold cavity (previously coated with a vinyl chloride or other suitable mold release agent) of a size slightly greater than the desired final diameter of the core. The mating mold section is then closed over the slug followed by curing at a temperature greater than 295° F., e.g., 325° F., for 10–20 minutes, depending on the core temperature.

During curing, sulfur on the surface of the slug penetrates a surface layer to a depth of about 1/16 inch. In portions of the core exposed to the sulfur, the conventional peroxide cure is altered, resulting in a relatively amorphous, soft outer layer. The central portion cures normally, is unaffected by the sulfur, and becomes relatively crystalline. After curing, a thin surface layer of the core is ground off.

The process as described above is illustrated in FIG. 2.

A ball 10 made in accordance with the foregoing procedure is depicted in FIG. 1, covered with a conventional cover formulation. As illustrated, it has an outer layer 12 about 1/16 inch thick (0.072 inch) having an average Shore A hardness of 74. Its central portion 14 has an average Shore C hardness of 82. The line depicting the transition from the central portion 14 to the outer layer 12, and regions adjacent the line, define a hardness gradient with hardness value intermediate those of the central portion and the outer layer.

The invention may be embodied in other specific forms without departing from the spirit and scope thereof. Accordingly, other embodiments are within the following claims.

What is claimed is:

1. A golf ball having a molded cover and a separately molded, resilient, spherical core, said core comprising:

a central portion having a Shore C hardness greater than 75; and, an outer layer, integral with and disposed radially outwardly from said central portion, having a Shore A hardness less than 80, and a thickness greater than 1/32 inch.

2. The ball of claim 1 wherein the central portion comprises a first, cross-linked elastomer and the outer layer comprises a second elastomer cross-linked differently from said first elastomer.

3. The ball of claim 2 wherein said first and second elastomers comprise the same elastomer.

4. The ball of claim 1 wherein said core comprises an elastomer material having a hardness gradient between said central portion and said outer layer formed during a simultaneous cure of said central portion and said outer layer.

5. The ball of claim 1 wherein said core comprises cross-linked polybutadiene.

6. The ball of claim 5 wherein said core comprises a metal salt of an alpha, beta ethylinically unsaturated monocarboxylic acid.

7. The ball of claim 6 wherein said core comprises a zinc salt selected from the group consisting of zinc diacrylate, zinc dimethacrylate, zinc monoacrylate, zinc monomethacrylate, and mixtures thereof.

8. The ball of claim 7 wherein said core comprises a peroxide-cured polybutadiene.

9. The ball of claim 5 wherein said core comprises a peroxide-cured polybutadiene.

10. The ball of claim 5 wherein said outer layer is cross-linked in part by sulfur.

11. The ball of claim 1 wherein said central portion has a Shore C hardness greater than 80.

12. The ball of claim 1 wherein said outer layer has a Shore A hardness less than 75.

* * * * *